US005115723A

United States Patent [19]

Wang

[11] Patent Number: 5,115,723

[45] Date of Patent: May 26, 1992

[54] HEIGHT ADJUSTING DEVICE

[76] Inventor: John Wang, No. 129, Tuan-Chu Lane, Tuan-Chu Li, Chiayi City, Taiwan

[21] Appl. No.: 693,633

[22] Filed: Apr. 30, 1991

[51] Int. Cl.[5] ..... F15B 21/00; F16F 9/32

[52] U.S. Cl. ..... 92/5 R; 188/300; 267/64.12

[58] Field of Search ..... 91/5; 267/64.12; 188/300

[56] References Cited

U.S. PATENT DOCUMENTS

| | | | |
|---|---|---|---|
| 3,415,159 | 12/1968 | Hornlein et al. | 91/5 |
| 3,828,651 | 8/1974 | Dorner et al. | 188/300 X |
| 3,913,901 | 10/1975 | Molders | 188/300 X |
| 4,318,536 | 3/1982 | Bauer | 188/300 X |
| 4,824,081 | 4/1989 | Pauliukonis | 267/64.12 |
| 4,856,762 | 8/1989 | Selzer | 267/64.12 |
| 5,005,677 | 4/1991 | Bucholtz et al. | 188/300 X |

FOREIGN PATENT DOCUMENTS

| | | | |
|---|---|---|---|
| 46333 | 2/1990 | Japan | 267/64.12 |

*Primary Examiner*—Edward K. Look
*Assistant Examiner*—John Ryznic
*Attorney, Agent, or Firm*—Fish & Richardson

[57] ABSTRACT

A height adjusting device includes an outer cylinder, an inner cylinder disposed inside the outer cylinder, a fluid reservoir confined by the inner cylinder, and a fluid receiving space formed between the inner and outer cylinders. Fluid flows from the fluid reservoir to the fluid receiving space to retract the height adjusting device. A piston is provided between the inner and outer cylinders and is biased by a spring member to force fluid in the fluid receiving space to flow back into the fluid reservoir, causing expansion of the height adjusting device. The height adjusting device further includes a flexible fluid resisting ring that prevents untimely expansion of the height adjusting device by hindering fluid flow from the fluid receiving space into the fluid reservoir, which fluid flow is caused by the expanding force of the spring member.

2 Claims, 3 Drawing Sheets

HEIGHT ADJUSTING DEVICE

BACKGROUND OF THE INVENTION

1. Field of the Invention

The invention relates to a height adjusting device, more particularly to an automatic height adjusting device which is retractable by fluid pressure and expandable by spring action and has provisions to prevent untimely expansion thereof which might otherwise result from the expanding force of a spring member.

2. Description of the Related Art

FIG. 1 is an illustration of a height adjusting device 1 by the applicant, which device 1 is retractable by fluid pressure and expandable by spring action. Stoppers, 12 and 13, plug both ends of an outer cylinder 11 and an inner cylinder 14 disposed inside the outer cylinder 11. A clearance 15 is left between the outer and inner cylinders, 11 and 14. A helical spring (16A) is disposed in the clearance 15 around the inner cylinder 14. A piston 17 is provided inside a fluid reservoir 141 confined by the inner cylinder 14. A piston shaft 171 is connected to the piston 17 and extends through the stopper 13. A slidable piston 18 is disposed in the clearance 15 between the stopper 12 and the helical spring (16A). The slidable piston 18 and the stopper 12 cooperatively confine a fluid receiving space 181. The stopper 12 has a longitudinal shaft opening 122 and a pair of fluid passages 121 which communicate the fluid receiving space 181 with the fluid reservoir 141 confined by the inner cylinder 14 via the shaft opening 122. A shaft 19 has a lowermost end extending through the shaft opening 122 and into the fluid reservoir 141. A valve piece 191 is provided on the lowermost end of the shaft 19 to selectively block the shaft opening 122. The uppermost end of the shaft 19 extends through a recess 123 formed on the topmost surface of the stopper 12. A switching member (A) is provided on the uppermost end of the shaft 19. A helical spring (16B) is disposed on the recess 123 and surrounds an uppermost portion of the shaft 19. One end of the helical spring (16B) is attached to the switching member (A). The helical spring (16B) biases the valve piece 191 to tightly block the shaft opening 122, preventing fluid from flowing between the fluid reservoir 141 and the fluid receiving space 181.

When incorporating the height adjusting device 1 in a height adjustable chair, the lowermost end of the piston shaft 171 is fixed to the chair support stand (not shown). A dust protective cover (B) is provided around the lowermost portion of the outer cylinder 11 to shield the piston shaft 171. The switch member (A) should be conveniently located and is operable by means of a lever or any similar device (not shown).

FIG. 2 is an illustration of the height adjusting device 1 when in use. To adjust the height of a chair incorporating the device 1, the switch member (A) is actuated to move downward, thereby compressing the helical spring (16B) and moving the shaft 19 downward to correspondingly remove the valve piece 191 from the shaft opening 122. The topmost end of the stopper 12 supports a load-bearing article, such as a chair seat (not shown). When downward pressure is applied to the stopper 12, the outer and inner cylinders, 11 and 14, simultaneously move downward. Since the valve piece 191 is displaced from the shaft opening 122, hydraulic fluid inside the fluid reservoir 141 is forced by the piston 17 to flow through the shaft opening 122 and the fluid passages 121 and into fluid receiving space 181. As the volume of hydraulic fluid inside the fluid receiving space 181 gradually increases, the piston 18 consequently moves downward, thereby compressing the helical spring (16A).

When the switch member (A) is released, the helical spring (16B) expands, thereby moving the valve piece 191 to once more block the shaft opening 122. Further downward movement of the outer and inner cylinders, 11 and 14, is stopped, thereby maintaining the chair seat at the desired height.

When the applied downward pressure on the stopper 12 is less than the biasing force of the helical spring (16A), and the valve piece 191 is in an open position, the helical spring (16A) gradually expands to return the stopper 12 to its former unadjusted position.

The foregoing shows that the helical spring (16B) provides the necessary biasing force to block fluid flow, while the helical spring (16A) provides the necessary biasing force to return the stopper 12 to its former unadjusted position.

Although the height adjusting device 1 is an improvement over other conventional types of height adjusting devices, it still has several defects: Referring once more to FIG. 2, the spring modulus of the helical spring (16A) should be relatively large to provide a biasing force strong enough to return the stopper 12 to its unadjusted position. To facilitate operation of the switch member (A), the spring modulus of the helical spring (16B) should be less than that of the helical spring (16A). The valve piece 191 is biased by the helical spring (16B) to block the shaft opening 122. However, the helical spring (16A) urges the piston 18 towards the stopper 12 with a much stronger force when the helical spring (16A) is in a compressed state. Slight upward movement of the piston 18 causes hydraulic fluid in the fluid receiving space 181 to flow into the fluid passages 121 and the shaft opening 122. Fluid in the shaft opening 122 opposes the biasing force of the helical spring (16B) and can remove the valve piece 191 from the shaft opening 122 even when the operator does not intend for this to happen.

A solution to this defect is to make the spring modulus of the helical spring (16B) larger than that of the helical spring (16A). This solution, however, is impractical since the size and space occupied by the helical spring (16B) would be larger than that of the helical spring (16A).

SUMMARY OF THE INVENTION

Therefore, the main objective of the present invention is to provide an improved automatic height adjusting device which has provisions to prevent untimely expansion which would otherwise result from the expanding force of a spring member.

Accordingly, the height adjusting device of the present invention includes an outer cylinder, an inner cylinder provided inside the outer cylinder and confining a fluid reservoir, an upper stopper plugging upper ends of the outer and inner cylinders, a lower stopper plugging lower ends of the outer and inner cylinders, a spring member disposed between the outer and inner cylinders, a first piston provided inside the inner cylinder, a stationary shaft connected to the first piston and extending through the lower stopper, and a second piston provided between the outer and the inner cylinders and between the upper stopper and the spring member. The outer and inner cylinders are movable vertically, relative to the stationary shaft. The second piston and the upper stopper cooperatively confine a fluid receiving space. The upper stopper has a longitudinal shaft opening and at least one fluid passage means intercommunicating the fluid receiving space and the fluid reservoir via the shaft opening. The fluid passage means includes a substantially longitudinal portion communicated with the fluid receiving space and a substantially transverse portion intercommunicating the longitudinal portion and the shaft opening. A movable shaft extends through the shaft opening and has a lowermost end extending into the fluid reservoir. A valve piece is provided on the lowermost end of the movable shaft to selectively block the shaft opening. The valve piece is biased to block the shaft opening. The movable shaft is moved downward to remove the valve piece from the shaft opening. Downward movement of the outer and inner cylinders can cause fluid inside the fluid reservoir to flow through the fluid passage means and into the fluid receiving space when the valve piece does not block the shaft opening. Upward movement of the outer and inner cylinders can cause fluid inside the fluid receiving space to flow through the fluid passage means and into the fluid reservoir when the valve piece does not block the shaft opening.

The movable shaft has an annular groove disposed at a level above the fluid passage means when the valve piece blocks the shaft opening. The upper stopper includes a fluid resisting ring positioned therein at a level below the transversely extending portion of the fluid passage means and surrounding the movable shaft. The ring can be urged by hydraulic fluid from the fluid receiving space to contact the movable shaft and stop fluid flow from the fluid receiving space to the fluid reservoir when the valve piece blocks the shaft opening and when the spring member is compressed by the second piston. The ring, however, can also be aligned with the annular groove when the valve piece is displaced from the shaft opening. The ring can thus prevent hydraulic fluid from the fluid receiving space from bearing against the valve piece when the valve piece blocks the shaft opening, thereby preventing untimely movement of the valve piece away from the shaft opening.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 3:
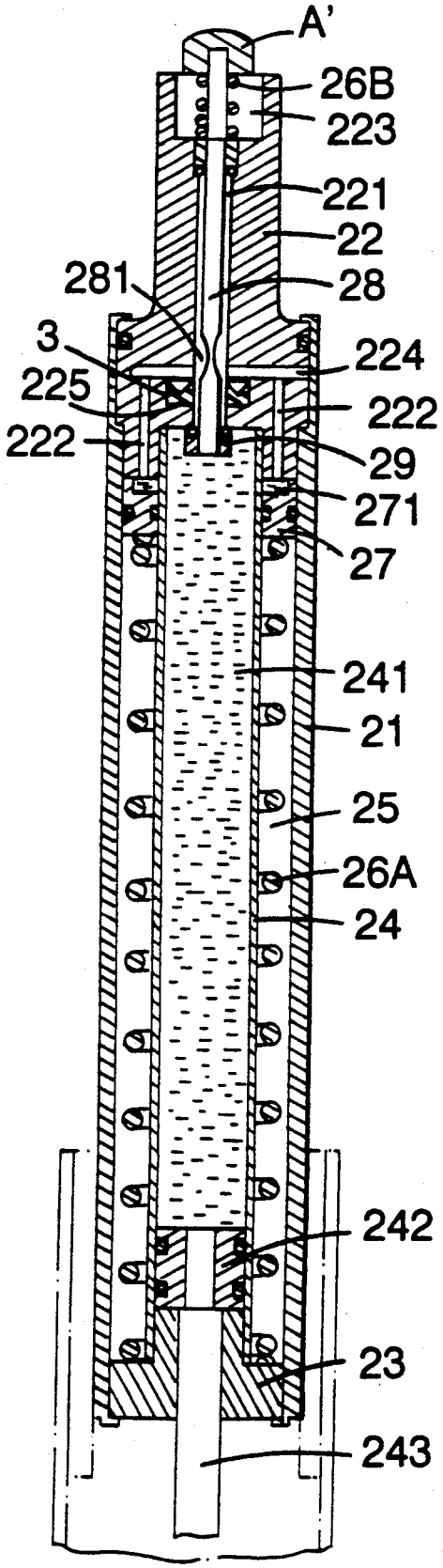
FIG. 3 is a sectional view of the preferred embodiment of a height adjusting device according to the present invention when in an initial unadjusted position.

Referring to FIG. 3, the preferred embodiment of a height adjusting device according to the present invention is shown to similarly comprise stoppers, 22 and 23, which plug upper and lower ends of an outer cylinder 21 and an inner cylinder 24 disposed inside the outer cylinder 22. A clearance 25 is left between the outer and inner cylinders, 21 and 24. A helical spring (26A) is disposed in the clearance 25 around the inner cylinder 24. A piston 242 is provided inside a fluid reservoir 241 confined by the inner cylinder 24. A stationary piston shaft 243 is connected to the piston 242 and extends through the stopper 23. A piston 27 is disposed in the clearance 25 between the stopper 22 and the helical spring (26A). The piston 27 and the stopper 22 cooperatively confine a fluid receiving space 271. The stopper 22 has a longitudinal shaft opening 221, and a fluid passage means including a pair of longitudinal fluid passages 222 disposed on either side of the shaft opening 221, and a transverse fluid passage 224 which intercommunicates the longitudinal fluid passages 222 and the shaft opening 221. The fluid passage means intercommunicates the fluid receiving space 271 and the fluid reservoir 241 confined by the inner cylinder 24 via the shaft opening 221. A shaft 28 extends through the shaft opening 221 and has a lowermost end extending into the fluid reservoir 241. A valve piece 29 is provided on the lowermost end of the shaft 28 to selectively block the shaft opening 221. The uppermost end of the shaft 28 extends through a recess 223 formed on the topmost surface of the stopper 22. A switching member (A') is provided on the uppermost end of the shaft 28. A helical spring (26B) is disposed on the recess 223 and surrounds an uppermost portion of the shaft 28. One end of the helical spring (26B) is attached to the switching member (A'). The helical spring (26B) biases the valve piece 29 to tightly block the shaft opening 221, preventing fluid from flowing between the fluid reservoir 241 and the fluid receiving space 271.

Figure 1:
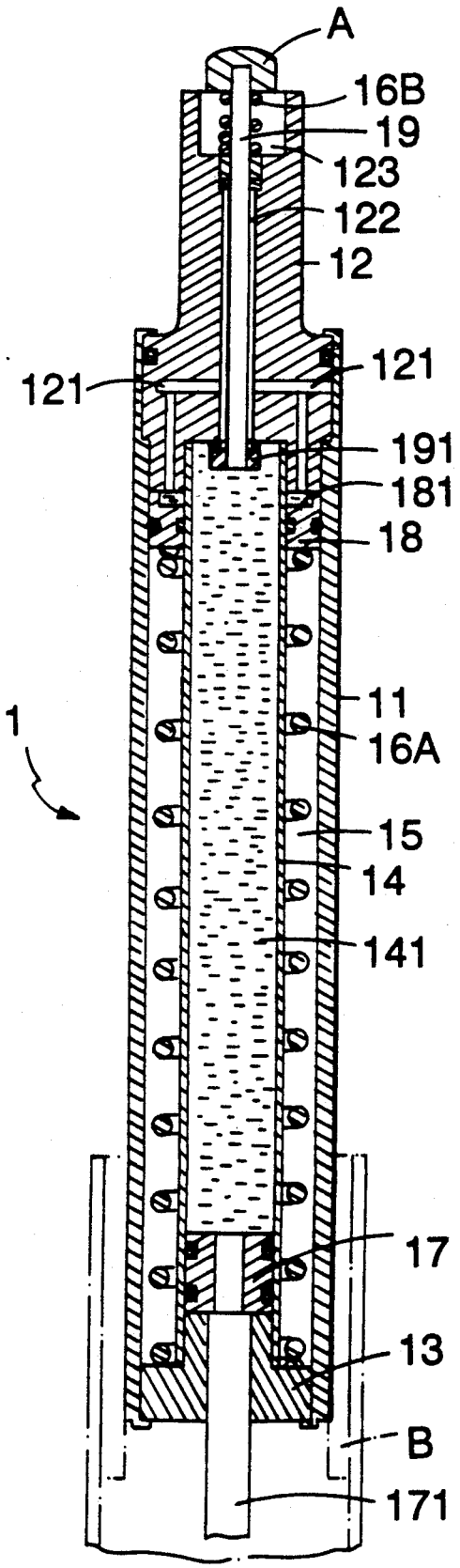
PRIOR ART FIG. 1
FIG. 1 is a sectional view of a conventional height adjusting device by the applicant when said device is in an initial unadjusted position.
Figure 2:
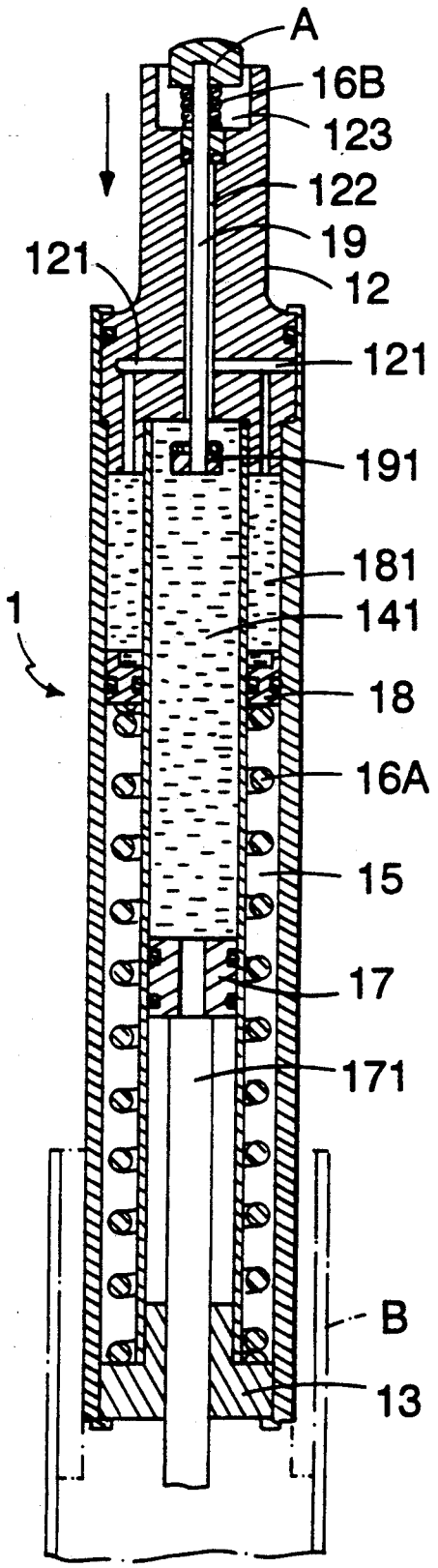
PRIOR ART FIG. 2
FIG. 2 is a sectional view of the conventional height adjusting device shown in FIG. 1 when said device is in an adjustable position.

The preceding paragraph discloses the features common to both the preferred embodiment and the conventional height adjusting device 1 shown in FIG. 1. The main differences between the preferred embodiment and the conventional height adjusting device 1 by the applicant are as follows: The shaft 28 has an annular groove 281 which curves inward and is disposed at a level above the longitudinal fluid passages 222 when the valve piece 29 blocks the shaft opening 221. The stopper 22 is provided with an annular receiving space 225 which is coaxial with and communicated with the shaft opening 221, and is disposed immediately below the transverse fluid passage 224. A fluid resisting ring 3 is received in the annular receiving space 225 and has a flexible annular convex inward lip portion 32. A gap 31 is left between the widest portion of the shaft 28 and the fluid resisting ring 3.

The operation of the preferred embodiment is as follows: FIG. 3 is an illustration of the preferred embodiment when the helical spring (26A) is in a fully expanded position, wherein the valve piece 29 blocks the shaft opening 221, thereby preventing fluid from flowing between the fluid reservoir 241 and the fluid receiving space 271.

Figure 5:
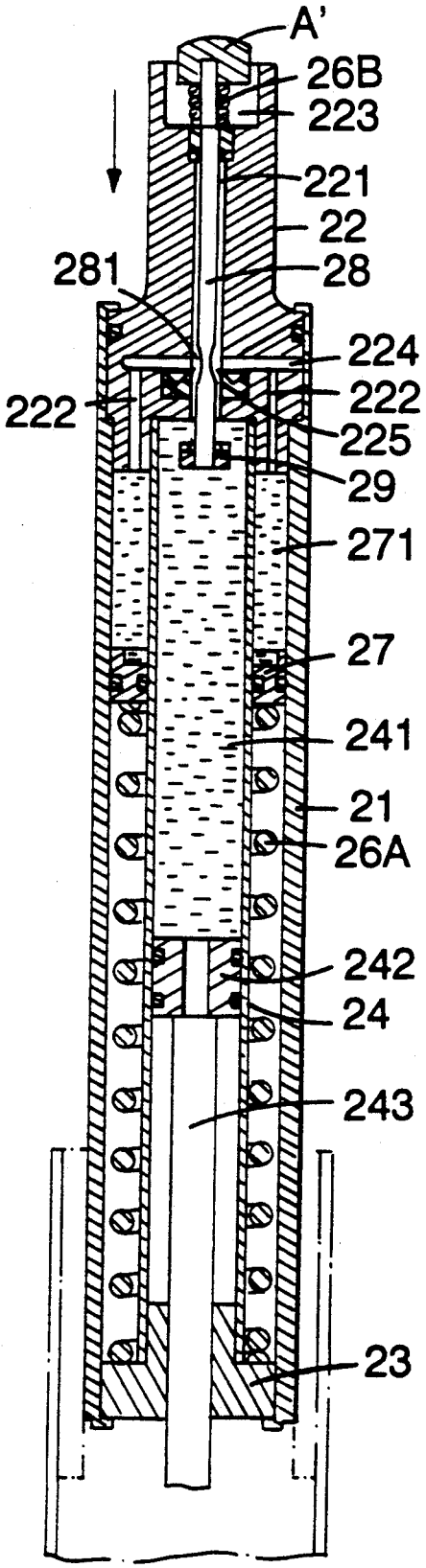
FIG. 5 is a sectional view of the preferred embodiment when in an adjustable position.
Figure 4:
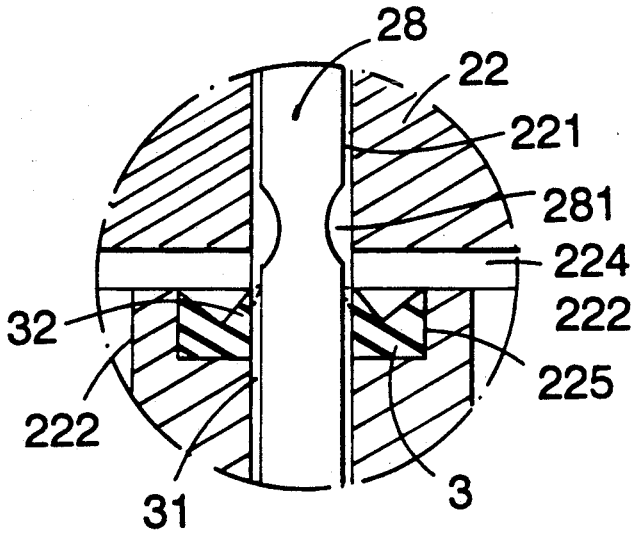
FIG. 4 is an enlarged view illustrating the characterizing features of the height adjusting device shown in FIG. 3.
Figure 6:
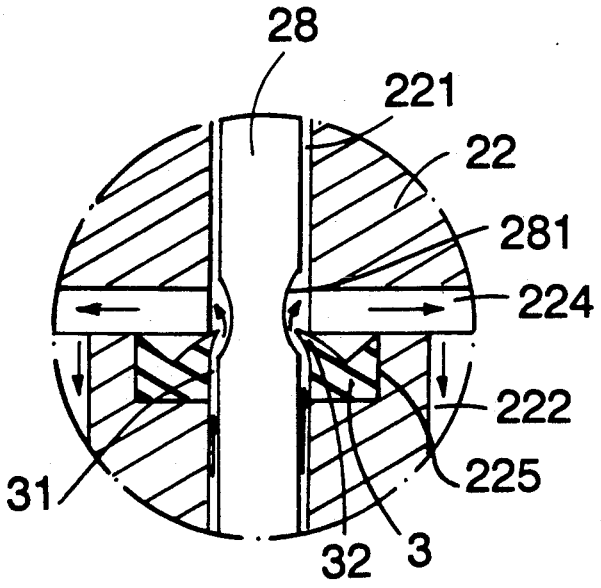
FIG. 6 is an enlarged view illustrating the positions of the characterizing features of the height adjusting device shown in FIG. 5.

Referring to FIGS. 5 and 6, to adjust the height of the preferred embodiment, the switch member (A') is actuated to move the shaft 28 downward to correspondingly move the valve piece 29 away from the shaft opening 221. Downward pressure applied to the stopper 22 by a load-bearing article (not shown) forces the outer and inner cylinders, 21 and 24, to simultaneously move downward. The annular groove 281 is aligned with the transverse fluid passage 224 and hydraulic fluid inside the fluid reservoir 241 is forced by the piston 242 to flow through the shaft opening 221 and the fluid passages, 222 and 224, and into fluid receiving space 271. (A larger gap 31 ensures smoother flow of hydraulic fluid to and from the fluid reservoir 241). As the volume of hydraulic fluid inside the fluid receiving space 271 gradually increases, the piston 27 consequently moves downward, thereby compressing the helical spring (26A).

When the switch member (A') is released, the helical spring (26B) expands, thereby moving the valve piece 29 to once more block the shaft opening 222.

Note that the spring modulus of the helical spring (26A) is larger than that of the helical spring (26B). The valve piece 29 is biased by the helical spring (26B) to block the shaft opening 221. The helical spring (26A) strongly urges the piston 27 towards the stopper 22 when the helical spring (26A) is in a compressed state. Thus, slight upward movement of the piston 27 causes hydraulic fluid in the fluid receiving space 271 to flow into the fluid passages, 222 and 224, thereby forcing the lip portion 32 of the fluid resisting ring 3 to bend inward and contact the shaft 28. Fluid in the fluid passages, 222 and 224, is thus prevented from bearing against the valve piece 29 by the lip portion 32 of the fluid resisting ring 3, which thus prevents untimely movement of the valve piece 29 away from the shaft opening 221. Untimely expansion of the preferred embodiment is thus prevented from occurring.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A height adjusting device including an outer cylinder; an inner cylinder provided inside said outer cylinder and confining a fluid reservoir; an upper stopper plugging upper ends of said outer and said inner cylinders; a lower stopper plugging lower ends of said outer and said inner cylinders; a spring member disposed between said outer and said inner cylinders; a first piston provided inside said inner cylinder; a stationary shaft connected to said first piston and extending through said lower stopper, said outer and inner cylinders being movable vertically relative to said stationary shaft; a second piston provided between said outer and said inner cylinders and between said upper stopper and said spring member, said second piston and said upper stopper cooperatively confining a fluid receiving space, said upper stopper having a longitudinal shaft opening and at least one fluid passage means intercommunicating said fluid receiving space and said fluid reservoir via said shaft opening, said fluid passage means including a substantially longitudinal portion communicated with said fluid receiving space and a substantially transverse portion intercommunicating said longitudinal portion and said shaft opening; a movable shaft extending through said shaft opening and having a lowermost end extending into said fluid reservoir; a valve piece provided on said lowermost end of said movable shaft to selectively block said shaft opening; biasing means to bias said valve piece to block said shaft opening; and actuating means to move said movable shaft downward against action of said biasing means to correspondingly remove said valve piece from said shaft opening, downward movement of said outer and said inner cylinders causing fluid inside said fluid reservoir to flow through said fluid passage means and into said fluid receiving space when said valve piece does not block said shaft opening, upward movement of said outer and said inner cylinders causing fluid inside said fluid receiving space to flow through said fluid passage means and into said fluid reservoir when said valve piece does not block said shaft opening, characterized in that said movable shaft has an annular groove disposed at a level above said fluid passage means when said valve piece blocks said shaft opening, said upper stopper including a fluid resisting ring positioned therein at a level below said transversely extending portion of said fluid passage means and surrounding said movable shaft, said ring being capable of being urged by hydraulic fluid from said fluid receiving space to contact said movable shaft and stop fluid flow from said fluid receiving space to said fluid reservoir when said valve piece blocks said shaft opening and when said spring member is compressed by said second piston, said ring being aligned with said annular groove when said valve piece is displaced from said shaft opening;

whereby, said ring can prevent hydraulic fluid from said fluid receiving space from bearing against said valve piece when said valve piece blocks said shaft opening, thereby preventing untimely movement of said valve piece away from said shaft opening.

2. The height adjusting device as claimed in claim 1, wherein said upper stopper has an annular receiving space coaxial with and communicated with said shaft opening, said fluid resisting ring being received within said annular receiving space and having a flexible annular lip portion which can bend inward to contact said movable shaft under hydraulic pressure of fluid from said fluid receiving space.

* * * * *